United States Patent [19]

Ness

[11] 4,146,821

[45] Mar. 27, 1979

[54] AC POWERED FLASH TUBE CONTROL CIRCUIT

[75] Inventor: Donald L. Ness, Brown Deer, Wis.

[73] Assignee: W. H. Brady Co., Milwaukee, Wis.

[21] Appl. No.: 805,797

[22] Filed: Jun. 13, 1977

[51] Int. Cl.[2] ..... H05B 37/00; H05B 39/00; H05B 41/14

[52] U.S. Cl. ..... 315/241 R; 315/241 P; 315/DIG. 7

[58] Field of Search ..... 315/84.5, 119, 240, 315/241 R, 241 P, DIG. 7, 200 A; 354/126, 135, 145

[56] References Cited

U.S. PATENT DOCUMENTS

| | | | |
|---|---|---|---|
| 3,753,039 | 8/1973 | Bonazoli et al. | 315/241 P X |
| 3,767,969 | 10/1973 | White et al. | 315/200 A |
| 3,946,271 | 3/1976 | Stepp et al. | 315/200 A X |
| 4,007,399 | 2/1977 | White | 315/241 R |
| 4,027,199 | 5/1977 | Johnson | 315/241 R |
| 4,075,536 | 2/1978 | Stevens | 315/241 R X |

*Primary Examiner*—Alfred E. Smith
*Assistant Examiner*—Robert E. Wise

[57] ABSTRACT

AC powered flash tube control circuitry includes an energy storage circuit and a firing circuit. The storage and firing circuits are triggered in each flash cycle in separate coordinated sequence in time synchronism with the frequency of the AC source to store energy in a first portion of each flash cycle and to trigger the tube into conduction in a second portion of the flash cycle during which energy from the storage circuit is discharged from the flash tube to produce an output flash of radiation.

11 Claims, 5 Drawing Figures

Figures 2A, 2C:
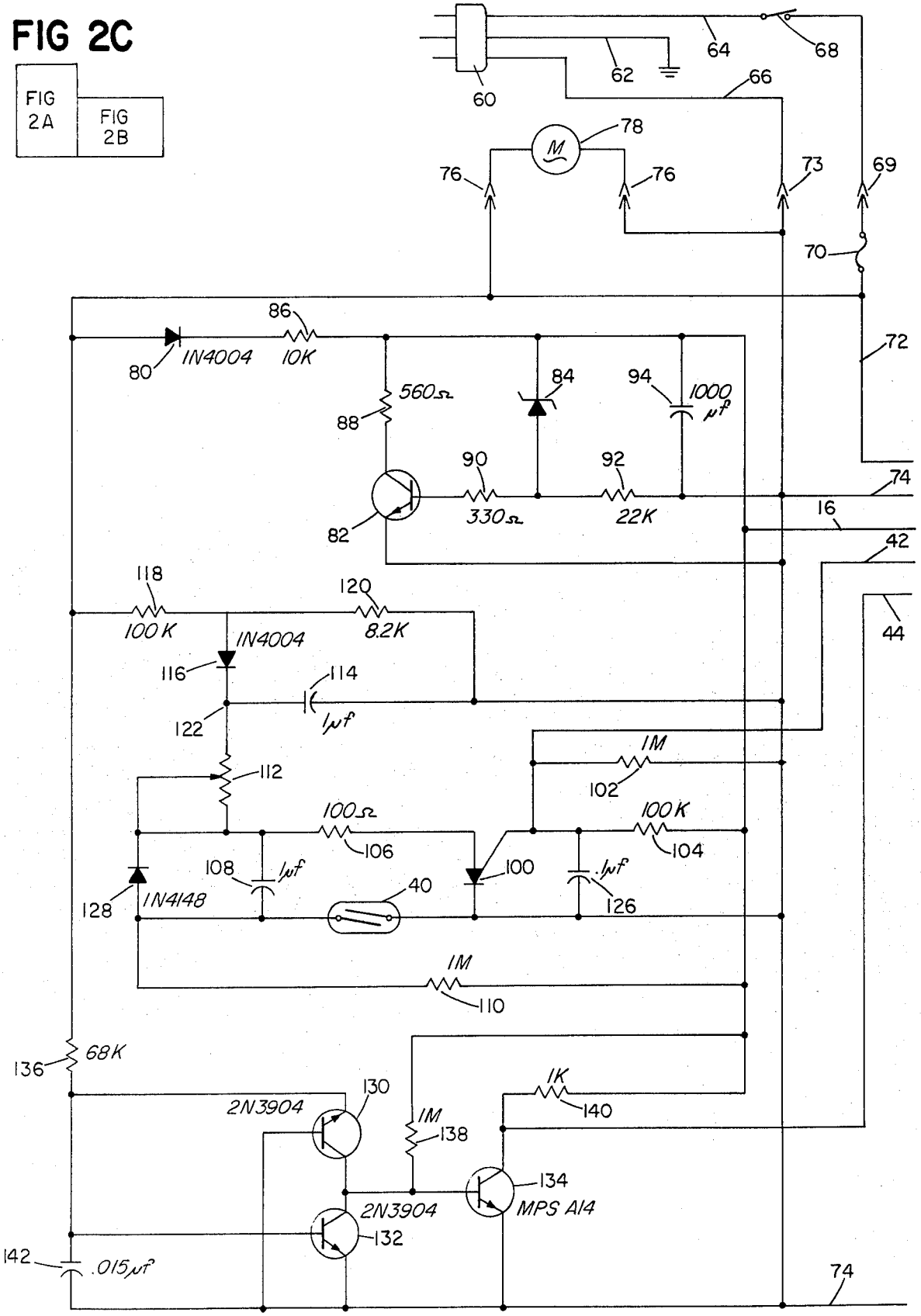

FIG 1
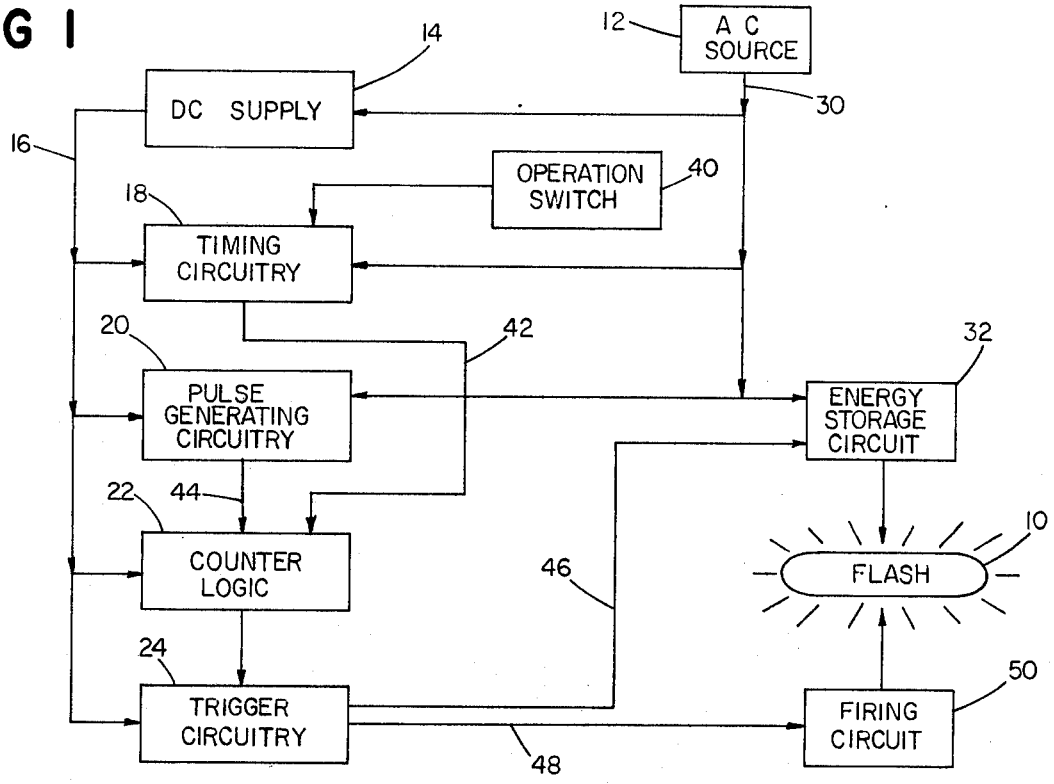
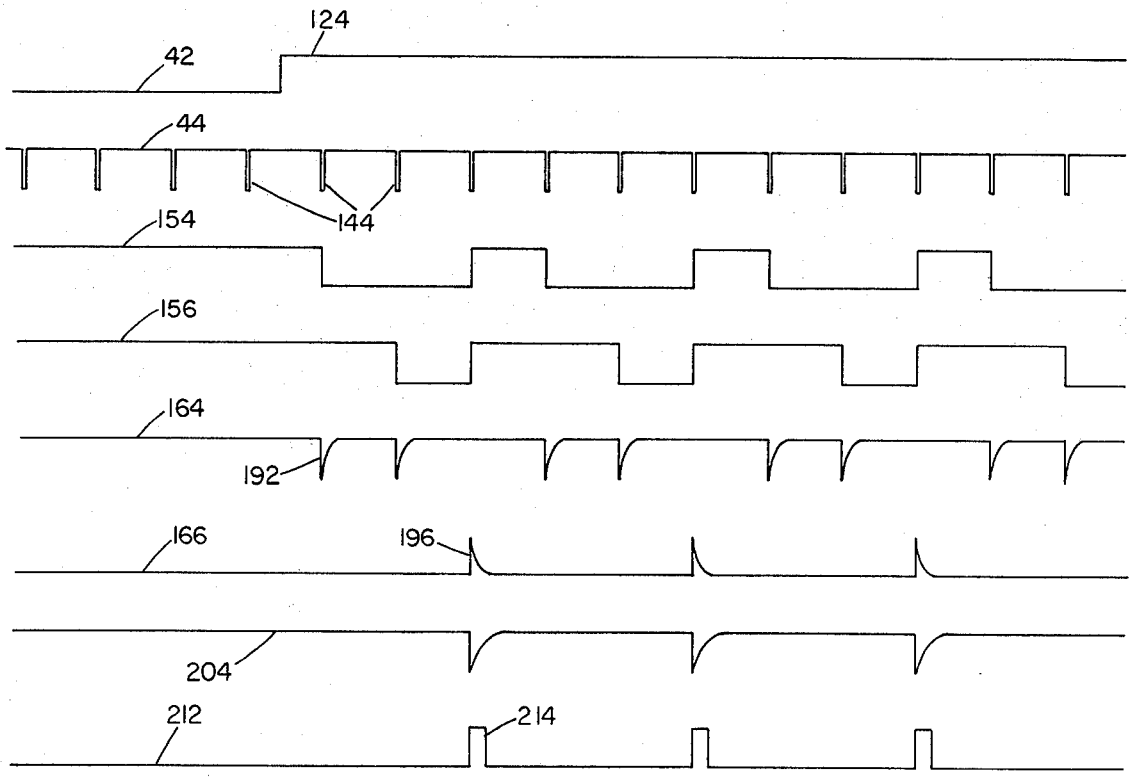
FIG 3

AC POWERED FLASH TUBE CONTROL CIRCUIT

FIELD OF THE INVENTION

This invention relates to electrical circuitry and more especially to electrical circuitry particularly useful in flash tube systems.

BACKGROUND OF THE INVENTION

U.S. Pat. Nos. 3,767,969 and 4,007,399 disclose flash tube control systems for generating a series of flashes. A particular use of such flash tube control systems is in the formation of images on radiation sensitive material, as in a label maker, and an object of the invention is to provide improved flash tube control systems for that use.

SUMMARY OF THE INVENTION

The invention provides AC powered electrical circuitry for controlling the repetitive firing of a flash tube to provide a rapid series of flash cycles. An energy storage circuit is connected to the flash tube and the tube is triggered into conduction by a firing circuit. In accordance with a feature of the invention, the storage and firing circuits are triggered in each flash cycle in separate coordinated sequence in time synchronism with the frequency of the AC source. Each flash cycle includes an energy storage interval in which energy from the AC source is stored in the energy storage circuit followed by a firing interval in which energy from the storage circuit is discharged through the flash tube to produce an output flash of radiation. The flash cycles occur in rapid sequence over an interval of timed duration. Preferably, the circuitry includes a control for varying the time duration of this interval as well as compensation as a function of the magnitude of the AC voltage so that the time duration of the flash sequence is an inverse function of that AC voltage magnitude.

In accordance with another aspect of the invention, a circuit is provided for supplying substantially constant DC voltage at its output terminals in response to AC power supplied at its input terminals. The circuit includes a rectifier connected to an input terminal and a storage capacitor connected across the output terminals. A first resistance is connected in series between the rectifier and the storage capacitor, and a series circuit of a second resistance and a switch is connected in shunt with the capacitor. The switch is controlled by a voltage sensing network that senses the voltage on the capacitor, that network closing the switch when the capacitor is charged to a predetermined voltage threshold and opening the switch when the voltage on the capacitor decreases to a second value below that threshold. Full AC voltage is applied to the capacitor when the switch is open so that the capacitor rapidly charges to the voltage threshold. A voltage below that threshold from a voltage divider network of the two resistances is applied to the capacitor when the switch is closed. In a preferred embodiment, the voltage sensing network includes a zener diode and the switch is a solid state device. This DC supply circuit provides rapid charging of the storage capacitor to the design DC voltage level for application to its output terminals, and maintains a substantially constant DC voltage at its output terminals by shifting the voltage applied to the storage capacitor between full AC line voltage and a reduced capacitor charging voltage that is below but close to the design DC voltage level from that voltage divider network.

This DC supply circuit is employed in a particular embodiment of flash tube control circuitry and supplies DC voltage as a reference to a line voltage compensated timer circuit that controls the duration of the flash sequence interval, a pulse generator that produces an output pulse in synchronism with each zero value of the AC signal, binary counter logic that is stepped by the AC synchronized pulses, and switching circuitry responsive to outputs from the counter logic for alternately triggering the energy storage circuit to store energy from the AC source and triggering the firing circuit to fire the flash tube. The energy storage circuit in that embodiment includes two storage capacitors and a full wave rectifier connected in voltage doubling relation. The storage circuit is triggered at the beginning of each of two successive half cycles of the AC source and the firing circuit is triggered at the beginning of the next (third) half cycle of the AC source. Protective circuitry for the counter logic is operative during each firing interval of the flash tube to prevent false triggering of the counter logic. Output signals from the counter logic are applied to the switching circuitry throughout the flash sequence interval as controlled by the timer circuitry. That timer circuitry includes a timing capacitor which is charged toward a voltage representative of the AC line voltage and terminates the sequence of flash discharges when the voltage on the timing capacitor reaches a reference value established by the DC supply circuit. A manually adjustable control enables the charging rate of the timing capacitor to be changed to vary the length of time the counter logic is enabled, and hence the time duration of the sequence of flash discharges.

PREFERRED EMBODIMENT

I turn now to description of a presently-preferred embodiment of the invention.

DRAWINGS

There is shown: in

FIG. 1, a block diagram of said embodiment; in

Figure 2B:
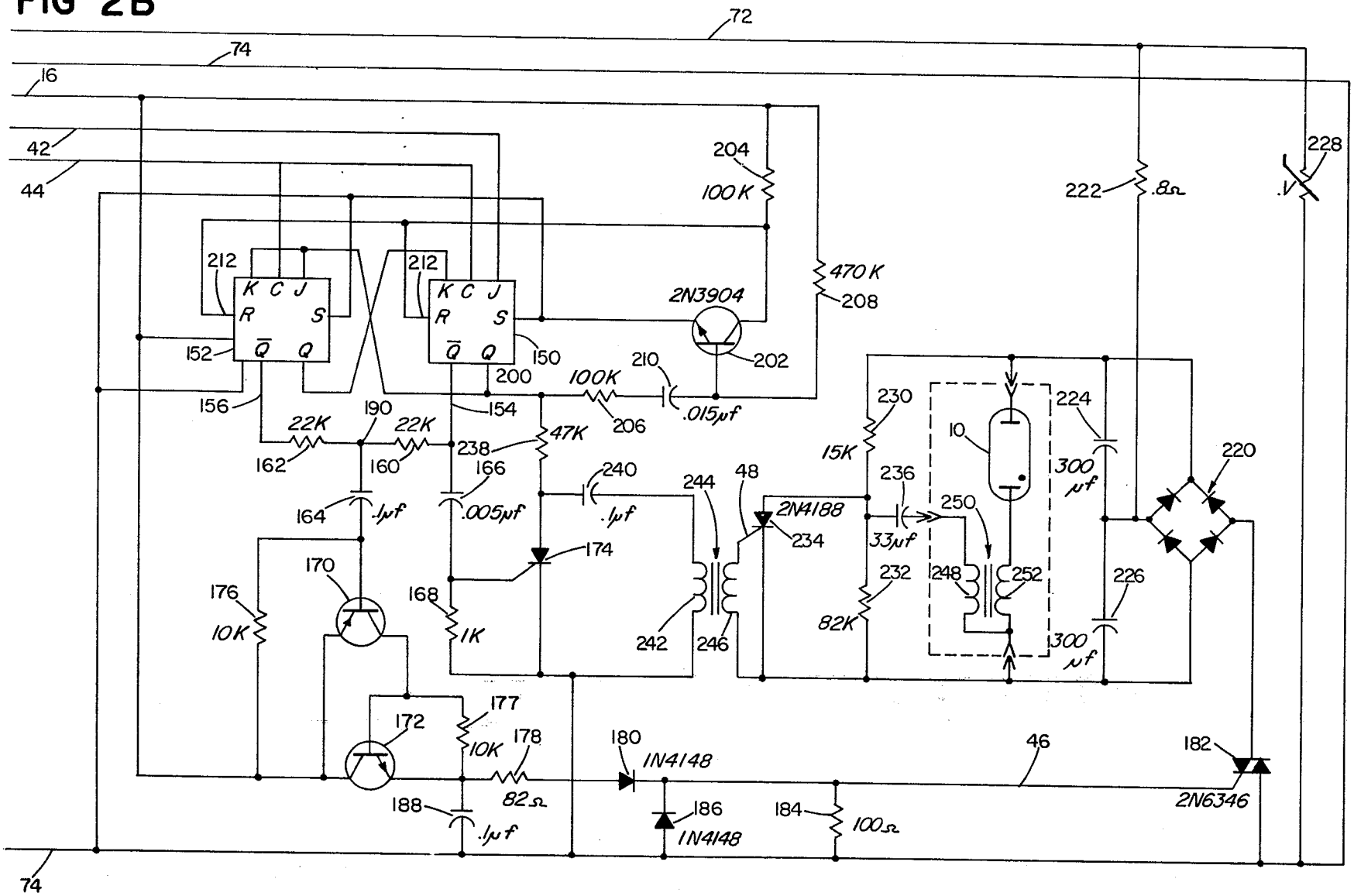

FIGS. 2*a* and 2*b*, arranged as shown in FIG. 2*c*, a schematic diagram of said embodiment; and in FIG. 3 a timing diagram.

DESCRIPTION

The embodiment shown in the drawings and its operation are now described.

1. Embodiment

The circuit shown in FIG. 1 controls the firing of xenon flash tube 10 and is energized from a 110-volt 60-cycle AC source 12. The circuit includes a regulated DC voltage supply 14 that converts 110-volt AC line power to approximately 8.5 volts DC and supplies this regulated DC voltage over line 16 to a flash timing circuit 18, pulse generating circuitry 20 that generates an AC synchronized output pulse each time the AC line voltage crosses zero (zero crossing detection), and steering circuitry that includes counter logic 22 and trigger circuitry 24. AC line voltage is applied over bus 30 to DC voltage supply circuit 14, flash timing circuitry 18, zero crossing detector pulse generating circuit 20, and flash tube energy storage circuit 32. When the operator depresses a "print" lever (not shown), control switch 40 is closed and flash timing circuit 18 generates an enable signal over line 42 to counter logic 22 and flash tube 10 is repeatedly fired over an interval of timed duration to produce an image on a label. The duration of this enable signal is determined by flash timing circuitry and is an inverse function of the AC line voltage. Pulse generating circuitry 20 applies an output pulse over line 44 to counter logic 22 whenever the 60-cycle AC line voltage crosses zero.

When an enable signal on line 42 from flash timing circuit 18 is present, counter logic 22 responds to pulses from the zero crossing detector circuit 20 and causes trigger circuitry 24 to produce alternate outputs on lines 46 and 48, the outputs on lines 46 being applied to flash tube energy storage circuit 32 to charge storage capacitors and the outputs on line 48 being applied to firing circuit 50 to fire the flash tube 10. Circuit 32 stores energy prior to the firing of the flash tube 10, and each time tube 10 is fired by firing circuit 50, stored energy from circuit 32 is discharged through flash tube 10 to produce a flash of ultraviolet radiation.

Further details of the system may be seen with reference to FIGS. 2A and 2B which when arranged as indicated in FIG. 2C provide the schematic diagram of the circuitry shown in FIG. 1. The system is connected to AC source 12 through plug 60 which has a ground terminal 62 and two output lines 64, 66. Line 64 is connected through power switch 68, disconnects 69 and fuse 70 to AC supply line 72 while the line 66 is connected through disconnects 73 to common line 74. Connected between lines 72, 74 through disconnects 76 is blower motor 78.

The DC supply circuit 14 includes rectifier diode 80, transistor 82, zener diode 84, resistors 86, 88, 90 and 92 and capacitor 94. AC line voltage is rectified by diode 80 and applied through resistor 86 to charge capacitor 94 towards the AC line voltage. Zener diode 84 senses the voltage on capacitor 94 and when the capacitor voltage exceeds the sum of the breakdown voltage of zener diode 84 and the base emitter voltage of transistor 82, diode 84 conducts and turns on transistors 82 to connect a voltage divider network of resistors 86 and 88 across AC lines 72, 74. Capacitor charging current from rectifier 80 is diverted through the voltage divider network, the voltage then applied to capacitor 94 being about five percent of peak AC line voltage. When the voltage on capacitor 94 drops below the breakdown voltage of diode 84, transistor 82 turns off and full line voltage is again applied to capacitor 94, providing rapid recharge of capacitor 94 to the design DC voltage supply level. This circuit thus holds the charge on capacitor 94 at a substantially constant level so that the output voltage on DC supply line 16 is maintained at approximately 8.5 volts. Resistor 90 is a current limiting resistor and resistor 92 functions to pull the base of transistor 82 to common (line 74) when the voltage on capacitor 94 is below the breakdown voltage of zener diode 84.

It will be seen that this voltage supply circuit provides a regulated DC voltage in which full AC line voltage (no reducing transformer) is applied to the output capacitor 94 and a voltage divider 86, 88 is switched into circuit when capacitor 94 is charged to the design voltage.

The flash timing circuit 18 includes a programmable unijunction transistor 100 with its cathode connected to common 74, its gate connected to a voltage divider network of resistors 102, 104 and to enable line 42, and its anode connected through resistor 106 to tantalum timing capacitor 108. One terminal of that timing capacitor is connected to normally open switch 40 (a magnetic reed switch) which is closed when the "print" lever is depressed by the operator, and through resistor 110 to DC supply line 16. The other terminal of capacitor 108 is connected through adjustable resistor 112 to a network of capacitor 114, diode 116 and resistors 118 and 120 that is connected to AC supply line 72. The AC line voltage is reduced (by a factor of about thirteen) by the voltage divider network of resistors 118 and 120 and that reduced voltage is rectified by diode 116 and stored on capacitor 114. Thus the DC voltage at junction 122 is proportional to the AC supply voltage.

In the conductive state of transistor 100, the voltage on the gate electrode is near DC common 74, and the voltage on the anode is also near DC common. Capacitor 108 is charged to a voltage determined by forward biased diode 128. Closure of switch 40 connects the lower terminal of capacitor 108 to DC common 74, thus pulling the anode of transistor 100 negative with respect to its gate and turning transistor 100 off. With transistor 100 in non-conductive state, the voltage on its gate rises to a value determined by the voltage divider network of resistors 102 and 104, providing an enable signal 124 (FIG. 3) on line 42. With transistor 100 off, capacitor 108 commences charging towards the voltage at junction 122 at a time constant rate determined by the setting of resistor 112. When the rising voltage on capacitor 108 causes the anode voltage to exceed the gate voltage by approximately 0.5 volts, transistor 100 reverts to a conductive state and terminates the enable signal on line 42. The DC voltage on capacitor 114 (a function of the AC line voltage) thus controls the duration of the enable signal on line 42. If switch 40 is opened at any time prior to the completion of the timing interval, resistor 110 will immediately cause the voltage at the transistor anode to increase and turn on that transistor, terminating the enable signal on line 42. Capacitor 126 provides protection against electrical noise that might affect the duration of the enable interval (timing period) and diode 128 protects capacitor 108 against reverse voltages. (When AC power is applied to the circuit by closing line switch 68, the voltage on capacitor 114 increases more rapidly than the voltage on capacitor 94 and this causes transistor 100 to switch to its conductive state, thus insuring that the flash tube 10 will not be triggered before switch 40 is closed by the operator.)

The zero crossing detector 20 includes transistors 130, 132 and 134; resistors 136, 138 and 140; and capacitor 142. AC line voltage on line 72 is current limited by resistor 136 and applied to the emitter of transistor 130 and to the base of transistor 132. Transistor 134 is turned on at each zero crossing of the AC line voltage so that its collector voltage is lowered to near zero for a short period, producing a negative going pulse 144 (FIG. 3) (zero crossing detection) which is applied on line 44 as an input to counter logic 22. During each positive half cycle of the AC voltage on line 72 (except when that voltage is below 0.7 volts) the emitter-base junction of transistor 132 is forward biased causing it to conduct and hold the base of transistor 134 at DC common (line 74) so that transistor 134 is turned off. Similarly, during each negative half cycle (except when the voltage is between zero and −0.7 volt), the emitter-base junction of transistor 130 is forward biased so that that transistor conducts and the voltage on its collector follows the line voltage and transistor 134 is turned off. However, during the intervals when the line voltage is between −0.7 volt and +0.7 volt, both transistors 130 and 132 are simultaneously turned off and the base-emitter junction of transistor 134 becomes forward biased, turning that transistor on and producing a negative going pulse 144 of short time duration on line 44 (zero crossing detection). It is preferred that transistor 134 be a high gain device (such as a Darlington pair) to provide sufficiently rapid transition of each pulse signal 144 on line 44 to provide reliable triggering of counter logic 22.

Counter logic 22 is shown in FIG. 2B and includes two JK flip flops 150, 152 connected as a module 3 counter. The outputs on the $\overline{Q}$ lines 154, 156 are normally high and can change state only when the enable line 42 is high and a zero crossing pulse 144 occurs on line 44. The first zero crossing pulse 144 after the enable signal 124 appears, triggers flip flop 150 to cause the output on line 154 to go low and the output on line 200 to go high. The next zero crossing pulse 144 triggers flip flop 152 and causes the output on line 156 to go low. The third zero crossing pulse triggers both flip flops causing the outputs on both lines 154 and 156 to go high as indicated in the timing diagram of FIG. 3, thus returning to their initial states and completing a flash cycle.

Connected to lines 154 and 156 is trigger circuitry 24 that includes a voltage divider network of resistors 160, 162, coupling capacitors 164, 166, a first trigger control circuit that includes transistors 170, 172 and a second trigger control circuit that includes SCR 174. Transistor 170 is normally biased off by resistor 176. A negative transition 192 coupled by capacitor 164 turns transistor 170 on, thereby conducting current to the base of transistor 172 to turn that transistor on and supply a positive pulse through resistor 178 and diode 180 over line 46 to triac 182. As soon as capacitor 164 recharges, transistors 170 and 172 turn off and terminate the triac triggering pulse (which has a duration of about two milliseconds). Resistor 184 acts to bias off the gate of triac 182, and diode 186 prevents excessive negative voltage from appearing on transistor 172 and capacitor 188 provides protection against false triggering of triac 182.

With reference again to FIG. 3, at the beginning of each flash tube firing cycle, lines 154 and 156 are both high and therefore at +8.5 volts. When flip flop 150 is triggered by an AC synchronized pulse 144 on line 44, line 200 rises to 8.5 volts and line 154 drops to zero volts, the voltage at junction 190 drops to 4.2 volts and a triggering transition 192 is applied by capacitor 164 to the base of transistor 170 turning on transistors 170, 172 to apply a triggering pulse over line 46 to gate electrode of triac 182. In response to the next AC synchronized pulse on line 44, flip flop 152 is complemented and the voltage on line 156 drops from 8.5 to zero volts applying a 4.2-volt transition to capacitor 164 producing pulse 192 to again turn on transistors 170 and 172 and again trigger triac 182. In response to the next pulse 144 on line 44, both flip flops are triggered and lines 154 and 156 rise to 8.5 volts, the transition being coupled by capacitor 166 as pulse 196 to the gate of SCR 174 to trigger that SCR into conduction.

Associated with counter logic 22 is a protective circuit that holds the flip flops 150, 152 in reset condition and prevents electrical noises during the firing of the flash tube from triggering the flip flops. That circuit includes transistor switch 202 with its emitter electrode connected to DC common 74, its collector electrode connected through resistor 204 to DC supply line 16, and its base electrode connected to line 200 via an RC circuit that includes resistors 206 and 208 and capacitor 210. The reset inputs 212 of flip flops 150 and 152 are connected to the junction between the collector of transistor 202 and resistor 204. Transistor switch 202 is normally conductive and thus maintains reset inputs 212 at DC common. When the Q output of flip flop 150 (line 200) goes low in response to the third pulse 144 in a flash cycle (the tube firing pulse), that transition is coupled through resistor 206 and capacitor 210 to turn off transistor 202. A pulse 214 of DC voltage from bus 16 is then applied to reset inputs 212 of flip flops 150, 152, holding those flip flops in reset condition and preventing electrical noise (e.g. from the firing of flash tube 10) from affecting the state of either flip flop. The length of time that transistor 202 is turned off (and hence the duration of pulse 214) is a function of the time constant of resistors 206, 208 and capacitor 210. It is only necessary that reset pulse 214 last longer than the duration of the light flash from tube 10.

Energy storage circuit 32 includes a full wave rectifier 220 that has one input terminal connected through resistor 222 to AC line 72 and another input terminal connected to triac 182. Connected across the rectifier output terminals is a voltage doubling network of capacitors 224 and 226. A varistor 228 absorbs high voltage spikes that may be present on the AC line. When an AC synchronized positive pulse on line 46 is applied to the triac gate, triac 182 is triggered and remains in conduction until the current through it approaches zero. In conduction, triac 182 completes the circuit between AC lines 72, 74, diode bridge 220 and the storage capacitors 224, 226. At the end of one half cycle one of the storage capacitors is charged to near peak line voltage. The next trigger pulse on line 46 triggers triac 182 into conduction again and the other storage capacitor 224, 226 charges towards peak line voltage in opposite polarity. Thus at the end of two half cycles, the voltage across the two capacitors 224, 226 is approximately twice the peak line voltage.

The firing circuit 50 includes a voltage divider network of resistors 230 and 232 that is connected across voltage doubling capacitors 224, 226 and that biases the anode of SCR 234 to a voltage of approximately 250 volts relative to its cathode and establishes that voltage on capacitor 236 immediately prior to a firing pulse. The firing circuit also includes isolation transformer 244 which isolates the DC portions of the control circuitry from the higher voltage AC portions, and firing transformer 250. When SCR 174 is triggered into conduction by a positive pulse 196 from capacitor 166, capacitor 240 discharges through the primary 242 of transformer 244. The resulting pulse induced in the secondary 246 of transformer 244 triggers SCR 234, dumping the 250-volt charge on capacitor 236 through the primary winding 248 of transformer 250. In response to that primary pulse, transformer 250 generates a pulse of about 7,000 volts at its secondary winding 252 which ionizes flash tube 10 and causes it to conduct so that supply capacitors 224, 226 discharge through tube 10, producing a flash of light.

Transistors 82, 100, 170 and 172, zener diode 84 and SCR 174 are components of an RCA type integrated circuit array CA3097E, while flip flops 150 and 152 are an RCA type CD4027F integrated circuit array.

2. Operation

In the embodiment shown, closure of line switch 68 applies power to the control circuitry and starts the blower motor 78. Capacitor 114 in timing circuitry 18 charges more rapidly than capacitor 94 in DC supply circuit 14 so that the timing circuit does not provide an enable signal on line 42 before switch 40 is closed. Pulse generating circuitry 20 commences generation of the series of zero crossing pulses 144 in time synchronism with the frequency of the AC source 12, but counter logic 22 does not respond until an enable signal on line 42 is provided from timing circuit 18.

When the operator depresses the "print" lever, switch 40 closes to turn off transistor 100 and initiate a series of flash cycles, controlled in duration by the timing circuitry 18, and specifically by the generation of the enable signal 124 on line 42 during the charging of capacitor 108. The enable signal duration may be varied by changing the setting of variable resistor 112 and is also a function of the AC line voltage as represented on capacitor 114. When capacitor 108 is charged sufficiently to turn on transistor 100 again, the enable signal 124 on line 42 falls, terminating the series of flash tube firings.

When enable signal 124 is present, counter logic 22 responds to the zero crossing pulses 144 over line 44 and tube 10 flashes on every third half cycle of the 60-cycle AC source. Trigger circuitry 24 applies an output over line 46 at the beginning of each of the first and second half cycles of the AC source in a flash cycle to trigger triac 182 and store energy in storage capacitors 224 and 226. The pulse 144 at the beginning of the third half cycle is applied by trigger circuitry 24 over line 48 to trigger SCR 234 in the flash tube firing circuit 50. The conduction of SCR 234 discharges capacitor 236, producing a 7,000-volt output pulse from transformer 250 that ionizes flash tube 10 and storage capacitors 224 and 226 discharge through that flash tube and producing an output flash of light. During this flash tube firing interval, the counter logic 22 is held in reset condition by the protective circuit of transistor switch 202 and is released after the end of the flash discharge to allow the counter logic to respond to the next zero crossing pulse 144.

This flash cycle sequence of three half cycles is repeated as long as the enable signal 124 from the timing circuitry 18 is high. At the end of the timed image interval, signal 124 drops and counter logic 22 no longer responds to the zero crossing pulses 144. Since the ultraviolet radiation from the flash tube 10 decreases as line voltage decreases, the circuit increases the number of flashes per image interval in proportion to the power line voltage reduction, so that the integral of ultraviolet radiation output for each image interval remains relatively constant. The timing is such that tube 10 flashes on every third half cycle of the 60-cycle AC line so that, for example, an image interval consisting of ten flashes will have a duration of fifteen AC cycles (one-quarter second).

CONCLUSION

Other embodiments are within the scope of the invention and claims. For example, the voltage doubling circuit is not required when a 220-volt AC source is utilized.

What is claimed is:

1. Electrical circuitry for controlling the repetitive firing of a flash tube comprising a flash tube, an energy storage circuit, a firing circuit, a source of pulses synchronized with the frequency of an AC source, and steering circuitry responsive to said synchronized pulses for triggering said energy storage circuit to store energy from the AC source during a first portion of each flash tube operating cycle and responsive to a subsequent one of said synchronized pulses for triggering said firing circuit to place said flash tube in conduction so that energy from said storage circuit is discharged through said flash tube to produce an output flash of radiation.

2. The circuitry as claimed in claim 1 and further including a timing circuit responsive to the magnitude of the AC supply voltage and controlling said steering circuitry so that the number of flash cycles in a flash sequence is an inverse function of the magnitude of the AC supply voltage.

3. The circuitry as claimed in claim 2 wherein said timing circuit is responsive to an operating control and includes a timing capacitor, and circuitry for charging said timing capacitor at a rate that is a function of the magnitude of the AC supply voltage to time the duration of said flash sequences.

4. The circuitry as claimed in claim 3 and further including manually adjustable means for controlling the charging rate of said timing capacitor.

5. The circuitry as claimed in claim 1 wherein said source of synchronized pulses includes zero crossing detector circuitry.

6. The circuitry as claimed in claim 1 wherein said steering circuitry includes binary counter logic that is stepped by said synchronized pulses, and switching circuitry responsive to the output of said binary counter logic for alternately triggering said storage circuit and said firing circuit to produce a rapid sequence of flash discharges.

7. The circuitry as claimed in claim 1 wherein said energy storage circuit includes a full wave rectifier and two storage capacitors connected in voltage doubling configuration, said storage circuit being triggered in response to a first synchronized pulse to store energy during a first AC half cycle and triggered again in response to the next synchronized pulse to store further energy during the next AC half cycle so that said storage circuit capacitors are charged to about twice the AC supply voltage, and said firing circuit is triggered by the next synchronized pulse to discharge energy from said storage capacitors through said flash tube in the immediately following AC half cycle.

8. The circuitry as claimed in claim 1 and further including isolation circuitry for preventing false triggering of said steering circuitry during the firing interval of said flash tube.

9. The circuitry as claimed in claim 1 and further including a timing circuit, including manually adjustable means, for controlling the number of flash cycles in a flash sequence, and circuitry for supplying a substantially constant DC voltage comprising input terminals for connection to said AC source and output terminals, a rectifier connected to an input terminal, a storage capacitor connected across said output terminals, a first resistance connected in series between said rectifier and said capacitor, a series circuit of a second resistance and a switch connected in shunt with said capacitor, and a network for sensing the voltage on said capacitor, said network being connected to close said switch when said capacitor is charged to a predetermined voltage threshold and to open said switch when the voltage on said capacitor decreases from said threshold to a second value so that AC line voltage is applied to said capacitor when said switch is open to rapidly charge said capacitor and a voltage below said threshold is applied to said capacitor from a voltage divider network of said first and second resistances when said switch is closed.

10. The circuitry as claimed in claim 9 wherein said energy storage circuit includes a full wave rectifier and two storage capacitors connected in voltage doubling configuration, said storage circuit being triggered in response to a first synchronized pulse to store energy during a first AC half cycle and triggered again in response to the next synchronized pulse to store further energy during the next AC half cycle so that said storage circuit capacitors are charged to about twice the AC supply voltage, and said firing circuit is triggered by the next synchronized pulse to discharge energy from said storage capacitors through said flash tube in the immediately following AC half cycle.

11. The circuitry as claimed in claim 10 wherein said steering circuitry includes binary counter logic that is stepped by said synchronized pulses, and switching circuitry responsive to the output of said binary counter logic for alternately triggering said storage circuit and said firing circuit to produce a rapid sequence of flash discharges, and further including isolation circuitry for preventing false triggering of said binary counter logic during the firing interval of said flash tube.

* * * * *